United States Patent [19]

Savage

[11] Patent Number: 4,491,408

[45] Date of Patent: Jan. 1, 1985

[54] ELECTROSTATOGRAPHIC SYSTEM DEVELOPMENT MODULATION

[75] Inventor: Edward C. Savage, Webster, N.Y.

[73] Assignee: Xerox Corporation, Stamford, Conn.

[21] Appl. No.: 567,729

[22] Filed: Jan. 3, 1984

[51] Int. Cl.[3] ..... G03G 15/08; G03G 15/09

[52] U.S. Cl. ..... 355/3 DD; 430/62; 118/644; 118/647; 118/657; 355/3 CH; 355/14 D; 355/14 E

[58] Field of Search ..... 355/3 DD, 3 BE, 3 DR, 355/16, 14 E, 14 D, 3 CH; 118/644, 647, 657; 430/62

[56] References Cited

U.S. PATENT DOCUMENTS

| | | | |
|---|---|---|---|
| 3,782,818 | 1/1974 | Smith | 355/10 |
| 4,034,709 | 7/1977 | Fraser et al. | 118/658 |
| 4,052,127 | 10/1977 | Kuroishi et al. | 355/3 DD |
| 4,087,171 | 5/1978 | Yano | 355/14 |
| 4,128,329 | 12/1978 | Kawano | 355/14 |
| 4,149,487 | 4/1979 | Kulbida et al. | 118/657 |
| 4,200,391 | 4/1980 | Sakamoto et al. | 355/14 E |
| 4,256,401 | 3/1981 | Fujimura et al. | 355/14 E |
| 4,306,804 | 12/1981 | Sakamoto et al. | 355/14 E |
| 4,310,237 | 1/1982 | Gengelbach | 355/14 E |
| 4,318,607 | 3/1982 | Bonham et al. | 355/3 DD |
| 4,343,548 | 8/1982 | Bares et al. | 355/3 DD |
| 4,375,328 | 3/1983 | Tsuchiya et al. | 355/14 E |
| 4,377,338 | 3/1983 | Ernst | 355/14 D |

*Primary Examiner*—John D. Welsh

*Attorney, Agent, or Firm*—Peter H. Kondo; John E. Beck; Ronald Zibelli

[57] ABSTRACT

An electrostatographic imaging system comprising an insulating layer having an imaging surface, a conductive substrate for the insulating layer, means to form an electrostatic latent image on the imaging surface, means to form a toner image on the imaging surface in conformance to the electrostatic latent image and means to supply a variable direct current voltage to the conductive substrate. The electrostatographic imaging system may include an electrically conductive member parallel to and spaced from the imaging surface and a means to supply a variable electrical bias to the electrically conductive member in response to a change in the value of direct current voltage supplied to the conductive substrate.

10 Claims, 8 Drawing Figures

ELECTROSTATOGRAPHIC SYSTEM DEVELOPMENT MODULATION

BACKGROUND OF THE INVENTION

This invention relates in general to electrostatography and more specifically to a novel system for controlling the charging potential of an electrostatographic imaging member.

In the art of electrostatography an electrostatic latent image is formed on an imaging surface of an insulating layer supported on a conductive substrate. The electrostatic latent image may be formed directly by various well known techniques such as charged stylus writing, corona charging through a mask, shaped electrodes, TESI, and the like. The electrostatic latent image may also be formed by electrophotographic techniques including uniformly depositing an electrostatic charge on a photoconductive insulating layer and exposing the photoconductive insulating layer to a pattern of activating electromagnetic radiation such as light which selectively dissipates the charge in the illuminated areas of the photoconductive insulating layer while leaving behind an electrostatic latent image in the non-illuminated areas. The electrostatic latent image may be developed to form a visible image by depositing finely divided electroscopic toner particles on the imaging surface. The resulting visible toner image can be transferred to a receiving member such as paper. This imaging process may be repeated many times with, for example, reusable photoconductive insulating layers.

Generally, in electrophotographic imaging systems, the electrophotographic imaging member and developer subsystems are optimized for the specific materials utilized, e.g. photosensitivity, development zone density and the like, and also for copy quality requirements, e.g. low background deposits, low density line reproduction and the like. After optimization, the photoreceptor and developer subsystems are fixed and only minor modifications can be made in charging or exposure levels to meet specific user requirements. In most cases, the only immediate controls over tone reproduction afforded the user are copy lighter control buttons and copy darker control buttons which vary the bias voltage of a development electrode such as the conductive member of a magnetic brush applicator roll. In some electrophotographic imaging systems, the bias to the development electrode is fixed at a given value and the operator is only allowed to vary the exposure. These approaches result in essentially the same, very limited, control over copy quality. A disadvantage of this is that copy darker control buttons enhance low density images, but increase copy background, whereas copy lighter control buttons suppress image information as well as reduce solid area contrast.

Features which allow variable control in a machine of the charge deposited by a corotron, require the use of complex and costly control circuits. The increased costs and complexity as well as the additional space required for control circuits render these approaches undesirable in compact, low volume copiers and printers.

SUMMARY OF THE INVENTION

It is an object of the present invention to provide an imaging system which overcomes the above-noted disadvantages.

It is another object of this invention to provide a means for controlling the surface potential of the imaging surface of electrostatographic imaging members.

It is another object of this invention to provide a means for controlling development electrode bias potential.

It is another object of this invention to provide a means for attaining a floating development electrode bias potential.

The foregoing objects and others are accomplished in accordance with the invention by providing an electrostatographic imaging system comprising an an insulating layer having an imaging surface, a conductive substrate for the insulating layer, means to form an electrostatic latent image on the imaging surface, means to form a toner image on the imaging surface in conformance to the electrostatic latent image and means to supply a variable direct current voltage to the conductive substrate. The electrostatographic imaging system includes an electrically conductive member parallel to and spaced from the imaging surface and a means to supply a variable electrical bias to the electrically conductive member in response to a change in the value of direct current voltage supplied to the conductive substrate. The electrically conductive member may comprise means to transport conductive developer material closely adjacent to the imaging surface, means for electrically insulating the transporting means relative to an electrical ground so that the charge on the imaging surface induces a charge on the transporting means that biases the transporting means to a potential intermediate the potential of image regions recorded on the imaging surface, and the potential of non-image regions of the photoconductive surface. The insulating layer may comprise at least one imaging insulating layer, and at least one photoconductive layer or a charge generating layer charge and charge transport layer.

The foregoing objects and other advantages will be more fully described in the following detailed description when read in conjunction with the accompanying figures.

DESCRIPTION OF THE PREFERRED EMBODIMENTS

Figure 1:
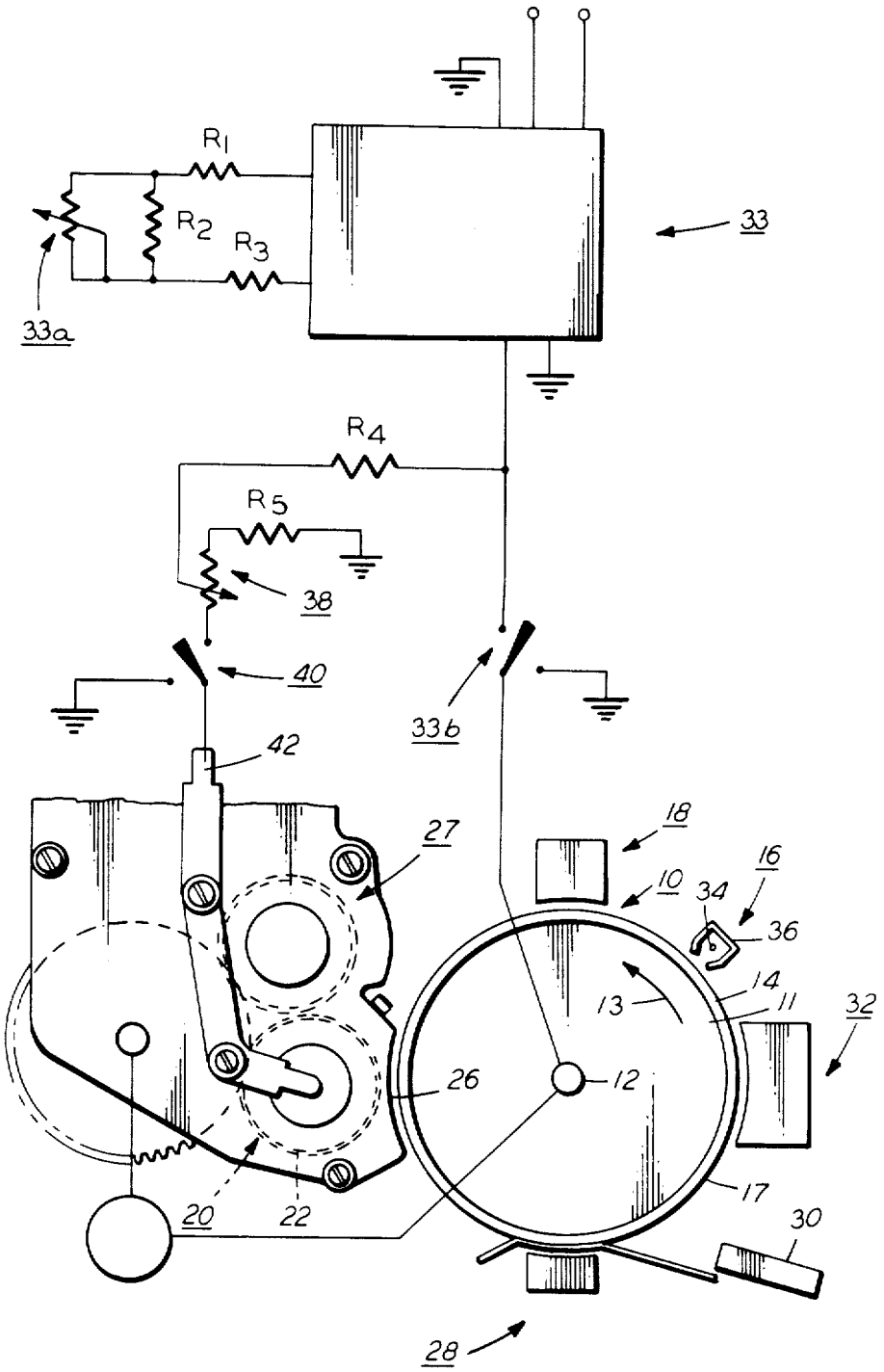
FIG. 1 is a partially sectional, partially schematic view of a composite electrostatographic imaging system including embodiments of the invention.

While the present invention will hereinafter be described in connection with the preferred embodiments and methods of use thereof, it will be understood that it is not intended to limit the invention to these embodiments and methods of use. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Inasmuch as the art of electrostatographic imaging is well known, the various processing stations employed in the FIG. 1 apparatus will be shown hereinafter schematically and the operation described briefly with reference thereto.

Referring now to FIG. 1, an electrostatographic imaging system is generally illustrated including an electrophotographic drum 10, supported on an electrically conductive shaft 12 for rotary movement in the direction of the arrow 13 sequentially through the various processing stations disposed about the path of movement thereof. The drum 10 comprises a cylinder 11 of electrically conductive material such as aluminum which is coated with an electrophotographic insulating layer 14 of suitable photoconductive material such as amorphous selenium, selenium alloy, combinations of a charge generation layer and charge transport layer and like. The electrically conductive material of cylinder 11 is in electrical contact with the electrically conductive shaft 12.

For the purpose of the instant disclosure, several copier workstations are shown positioned around the drum 10. First, a charging station 16 is provided adjacent the outer imaging surface 17 of drum 10 to uniformly charge the electrophotographic insulating layer 14 by application of uniform electrostatic charge of a predetermined potential. The charging station 16 may comprise any suitable corona charging device well known in the art.

At exposure station 18, the electrophotographic insulating layer 14 is exposed to activating radiation in image configuration by a suitable means such as a conventional light lens system. Alternatively, the activating radiation and image configuration can be supplied by a laser source controlled by computer, also is well known in the art. The activating radiation dissipates the electrostatic charge in the exposed areas of the electrophotographic insulating layer to form an electrostatic latent image.

Figure 2:
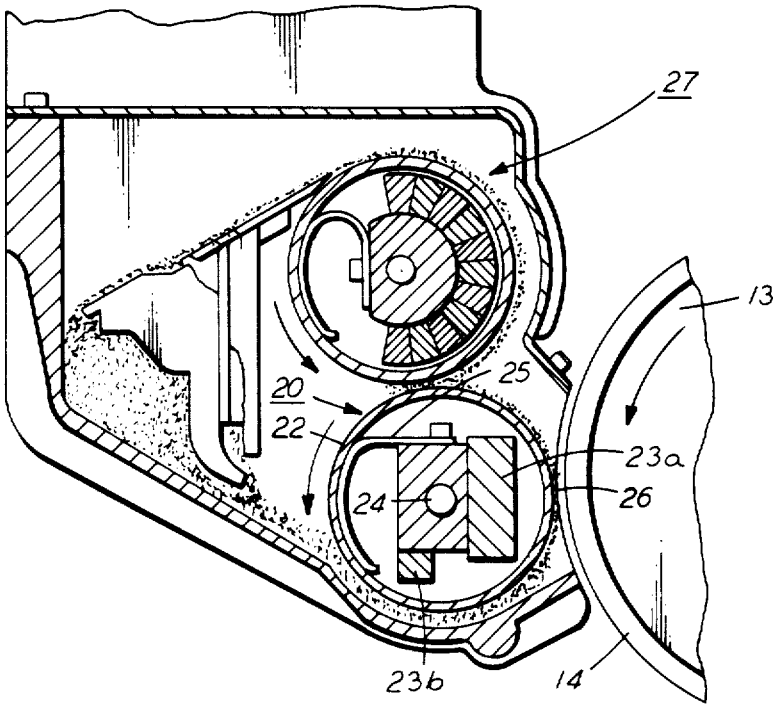
FIG. 2 is a partially sectional, partially schematic view of a magnetic brush developing station.

As is well understood in the art, the magnetic brush developing station 20 illustrated in FIG. 1 and FIG. 2 may comprise an electrically conductive, non-magnetic applicator cylinder 22 such as aluminum enclosing brush forming magnet 23*a* and pickup magnet 23*b*. The cylinder 22 is supported by end caps (not shown) on an electrically conductive, stationary shaft 24. Electrical contact between the cylinder 22 and shaft 24 may be effected by any suitable conventional means such as slip ring coupling 25. Both cylinder 22 and drum 10 are driven by motor M via conventional gear trains. An example of a suitable magnetic brush which can be used in accordance with the invention is illustrated in U.S. Pat. No. 3,764,866, the entire disclosure being incorporated herein in its entirety. The magnetic brush developing station 20 brings into contact with the imaging surface of electrophotographic insulating layer 14 a magnetic brush developer 26 which may comprise electroscopic toner particles having an electrostatic charge opposite to that of the electrostatic latent image. Electroscopic toner particles are attracted to and deposit on the imaging surface of the electrophotographic insulating layer 14 in image configuration to form a toner image. Excess developer is removed from the upper surface of developing station 20 by a magnetic lifting unit 27 for recirculation to the lower surface of developing station 20. The toner image on insulating layer 14 may then be transferred to a receiving member at the transfer station 28. After transfer of the unfixed toner image to a receiving member, the receiving member may be transported by conventional means to a fusing station 30 where the image is fixed to the receiving member. Cleaning of the insulating layer 14 may be effected at a cleaning station 32.

The term "image contrast" is defined as the difference between light and dark areas of a receiving member. When a dark image is formed on a light colored receiving member, contrast between light and dark areas on the receiving member increases with darker images if the intensity of the light areas remain constant. This contrast appears as a difference in toner image density and as a difference in voltage (voltage contrast) on the insulating layer 14 which corresponds to the light and dark areas of a receiving member.

The term "voltage contrast" is defined as the difference between the image voltage ($V_{image}$) on the insulating layer 14 which correlates to the dark areas of a receiving member and the image voltage ($V_{image}$) on the insulating layer 14 which correlates to the light areas. The greater the "voltage contrast," the greater the "image contrast" excluding development saturation.

The term "brightness" is defined as the minimum input density that will form a visible toner image on an imaging member.

The term "$V_{ddp}$" is defined as the dark development potential of the electrostatic latent image. It is the charge on the surface of a photoconductive layer after charging but prior to exposure.

The term "$V_{image}$" is defined as the potential on the photoreceptor surface as read by an electrometer (that which the magnetic brush developer applicator "sees") after exposure. This potential affects the amount of toner deposited on the electrostatic latent Image.

The term "$V_{BG}$" is defined as the potential on the photoreceptor surface in background or discharged areas after charging and exposure to activating radiation.

A direct current potential supplied by a conventional programmable low voltage power supply 33 to the electrically conductive cylinder 11 through switch 33*b* and shaft 12 may be altered by potentiometer 33*a*. Thus, by merely adjusting the potentiometer 33*a*, the direct current potential applied to the electrically conductive cylinder 11 through shaft 12 may be altered to increase or decrease the slope of the photoreceptor discharge curve. For example, if the surface of the electrophotographic insulating layer 14 is to be uniformly charged to a constant positive potential at charging station 16, the application of a negative DC voltage through shaft 12 to drum 10, alters the slope of the photoreceptor discharge curve as if the photoreceptor had been charged to a higher potential and discharged to a lower potential. This effect is illustrated by curves A and B in FIG. 3 obtained with an electrophotographic insulating layer 14 having a thickness of about 60 micrometers. The values for these curves were obtained after the high voltage power supply 35 shown in FIG. 4 was initially set to provide a $V_{ddp}$ of +800 volts with the switch 33*b* set to allow the conductive cylinder 11 to be at ground or 0 potential. Curve A illustrates that a relatively shallow slope is obtained when $V_{image}$ is plotted against different input density units (neutral density units) when the conductive cylinder 11 was maintained at ground or 0 potential. Curve B illustrates that a relatively steep slope is obtained when $V_{image}$ is plotted against different input density units (neutral density units) when the conductive cylinder 11 was maintained at a potential of −800 volts by means of power supply 33 and appropriate setting of switch 33b. Thus, there is a significantly greater voltage difference or contrast between adjacent neutral density units in Curve B than in Curve A. This greater voltage difference provides a greater capability to develop out more subtle gray scale differences to form the final toner image. A positive direct current potential applied to the shaft 12 has the opposite effect. In other words, the potential applied to the corotron wire 34 in charging station 16 and the direct current voltage applied to the shaft 12, determines the degree of contrast obtainable in the final image.

Figure 4:
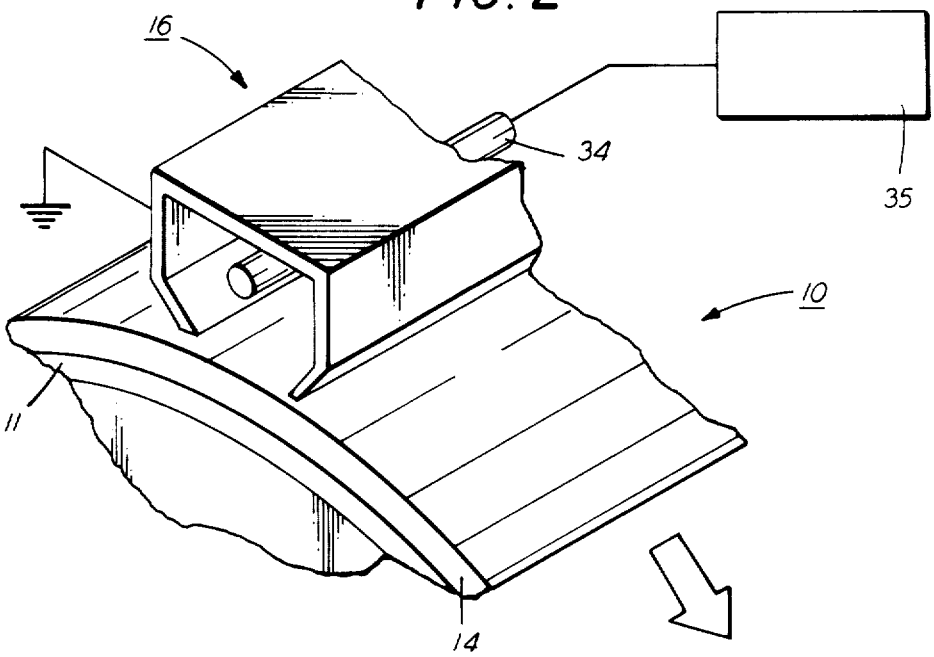
FIG. 4 is a partially sectional, partially schematic view of a charging station.
Figure 5:
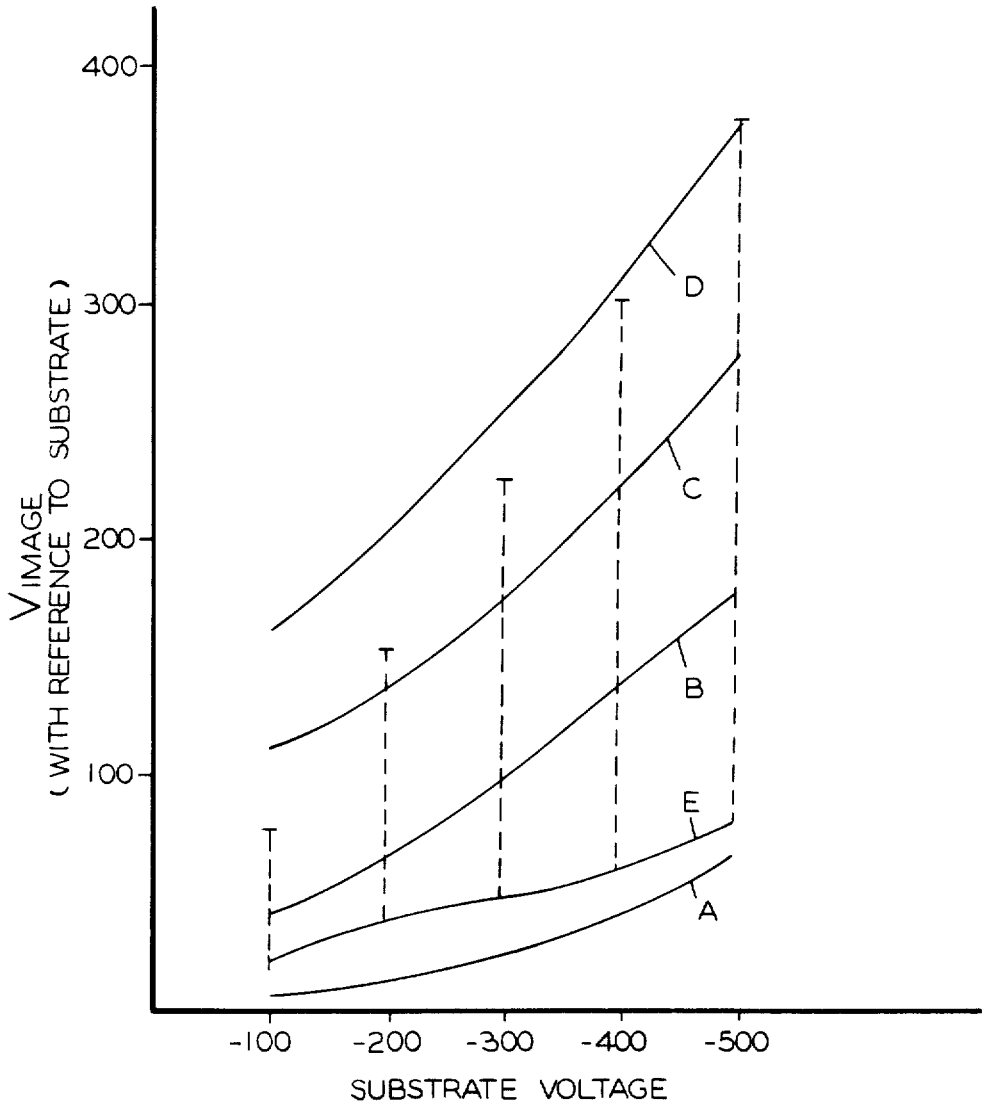
FIG. 5 is a graph illustrating an embodiment of this invention.

Referring now to FIG. 5, the high voltage power supply 35 shown in FIG. 4 was set at $V_{ddp}$ of +350 volts with cylinder 11 grounded by means of switch 33b. Various input voltages from power supply 33 regulated by settings of potentiometer 33a were then applied to cylinder 11 through shaft 12 and switch 33b. $V_{image}$ was plotted for five different substrate voltages for four different input densities as shown in FIG. 5 utilizing an electrophotographic insulating layer 14 having a thickness of about 20 micrometers. Curves A, B, C, and D were were obtained with input densities of white, 0.3 SAD, 0.5 SAD, and 0.7 SAD, respectively. SAD is an acronym for solid area density, i.e. the neutral density value of a solid area patch. These curves clearly show that a contrast voltage between different input densities can be increased dramatically by merely incrementally changing the substrate voltage from −100 volts to −500 volts.

Figure 3:
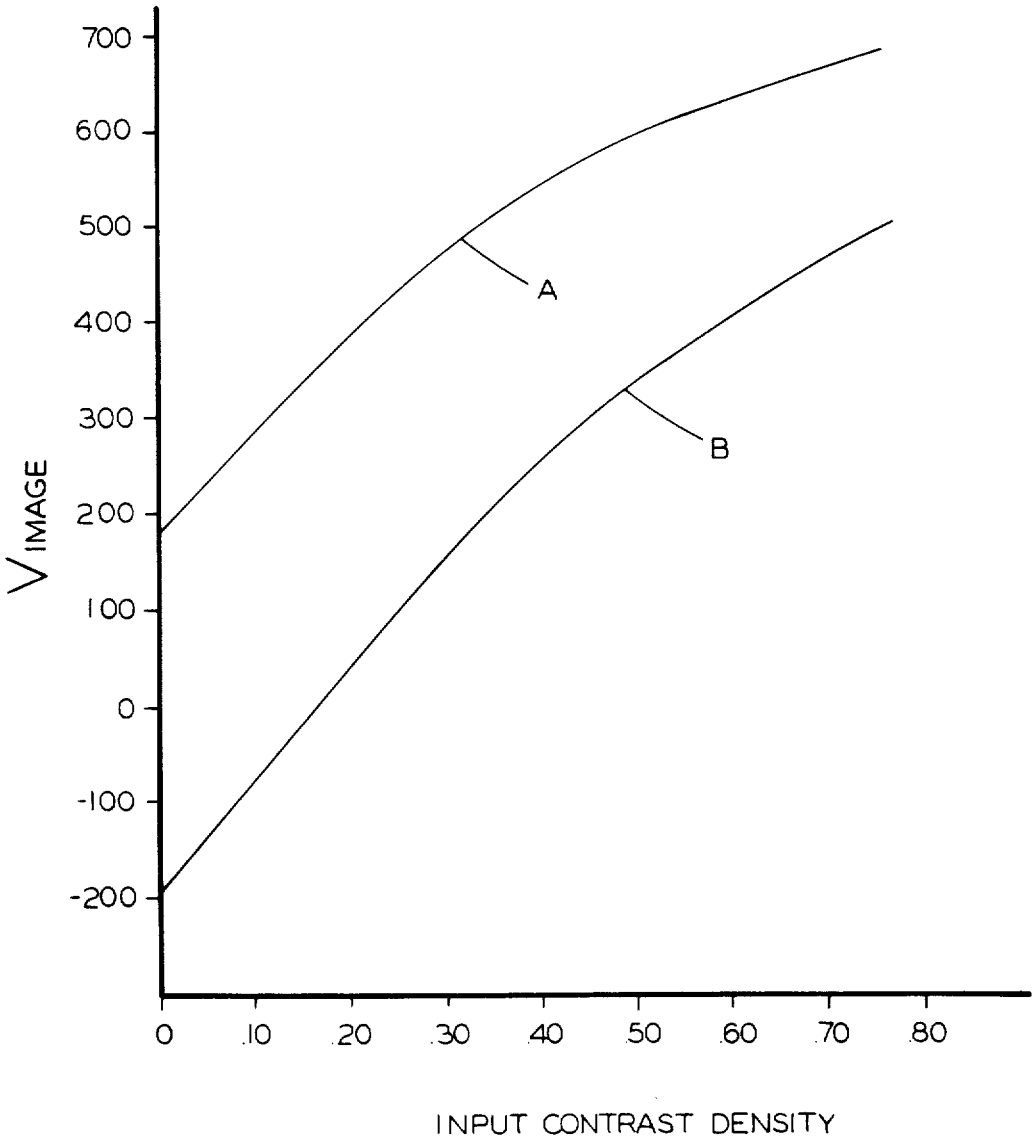
FIG. 3 is a graph comparing an embodiment of this invention with the prior art.
Figure 6:
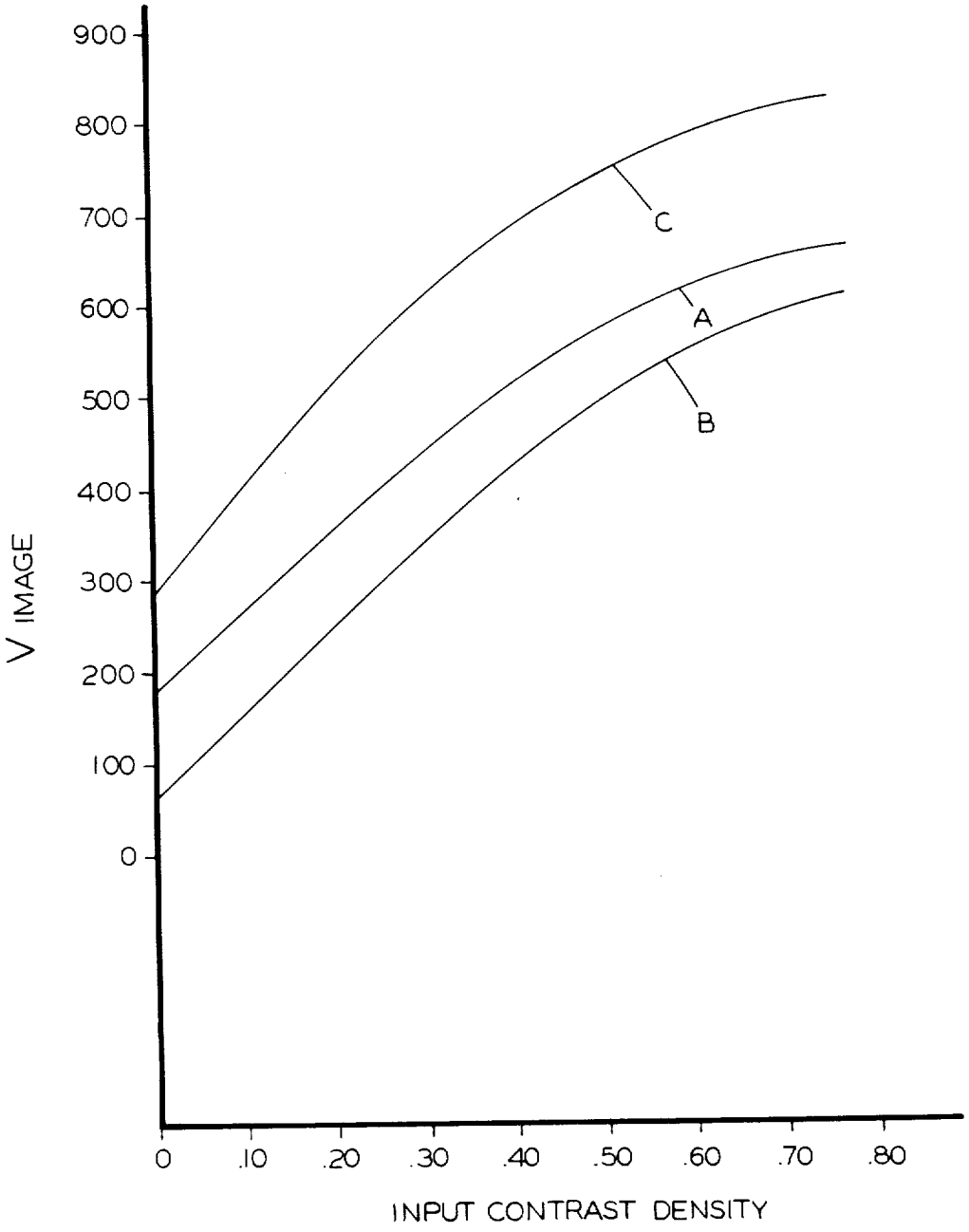
FIG. 6 is a graph illustrating an embodiment of the prior art.

For purposes of comparison, electrically conductive cylinder 11 through shaft 12 is grounded by means of switch 33b. The high voltage power supply 35 is thereafter set to provide a $V_{ddp}$ of +800 volts with a conductive cylinder at ground or zero potential. The $V_{BG}$ was +200 volts. In FIG. 6, curve A illustrates the slope obtained when $V_{image}$ is plotted against different input densities (neutral density) and is obtained when the conductive cylinder is maintained at ground or zero potential. This curve is identical to curve A in FIG. 3. Curve B illustrates how an increase in exposure only increases the slope slightly for higher density images but does not significantly affect low density images. Curve C illustrates the result of increasing $V_{ddp}$ only through changes of the output of the high voltage power supply 35. The slope of curve C for low density images increases but the change of the slope of curve C for high density images is only slight. These curves demonstrate that neither increasing the $V_{ddp}$ nor increasing the exposure alone is sufficient to cause an overall increase in the slope of the photoreceptor discharge curve. Absent any modification to the corotron charging potential or exposure level from curve A, curve B in FIG. 3 shows that applying −800 V DC to the photoreceptor conductive substrate 11 results in an overall steepening of the photoreceptor discharge curve as if the corotron charging potential had been increased (curve C, FIG. 6) and as if the exposure level had been increased (curve B, FIG. 6).

Thus, where the imaging surface 17 of the electrophotographic insulating layer 14 is charged with a uniform positive charge, the application of a direct current voltage having a negative polarity has the same effect as if the corotron wire 34 and voltage at charging station 16 was increased to provide a higher imaging surface potential. The efficiency of corotron wire 34 at charging station 16 is increased when a high negative voltage is applied to shaft 12 because the field between the corotron wire 34 and the electrically conductive cylinder 11 is larger than between the corotron wire 34 and the shield 36 which is grounded. Thus, by merely varying the amount and polarity of the direct current voltage applied to the shaft 12 controls image contrast. A positive potential was applied to the electrophotographic insulating layer 14 above for purposes of illustration only. In other words, a negative potential could be used instead of a positive potential, if desired, to achieve the same effect.

Absent any alteration of exposure settings, the direct current voltage applied to the shaft 12 may be readily changed by merely adjusting potentiometer 33a or any other suitable, well known variable load selection device so that the discharge curve is made steeper as if the exposure had actually been increased. Since photogeneration is a function of the applied electric field, the same amount of light can dissipate more charge thus making the discharge curve steeper. Also, by maintaining the exposure level constant and merely increasing the DC voltage to the conductive substrate, the photoinduced discharge curve profile can be altered to render the discharge curve steeper.

Figure 7:
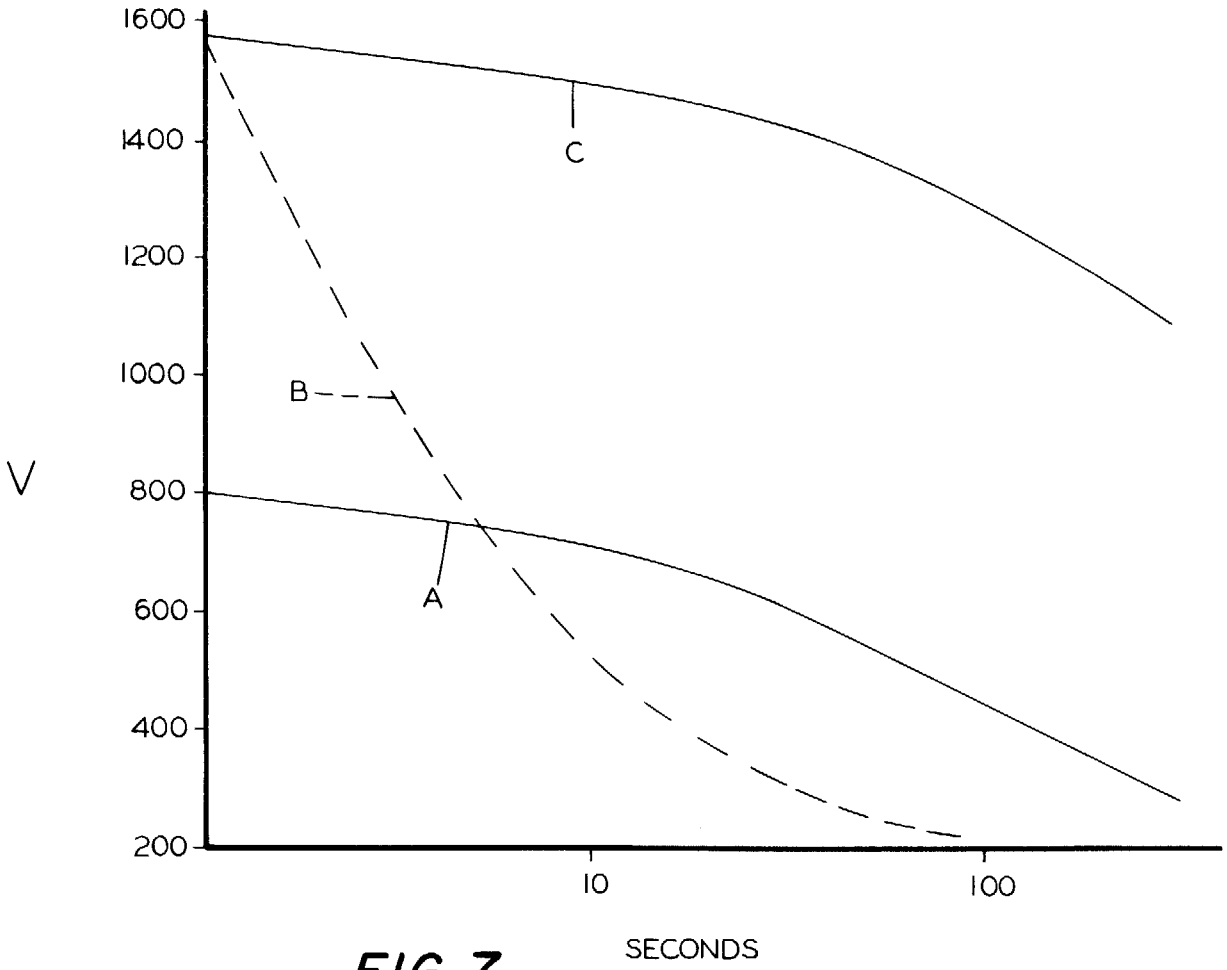
FIG. 7 is a graph comparing an embodiment of this invention with the prior art.

Shaft 12 was electrically grounded by means of switch 33b or any other suitable, well known variable load selection device and the photoconductive insulating layer 14 was charged prior to exposure by means of corotron wire 34 of charging station 16 connected to the high voltage power supply 35. The charge across insulating layer 14 was about +800 volts. The initial charge and subsequent dark decay was plotted and is illustrated in FIG. 7 as Curve A. The insulating layer 14 was then completely discharged. A direct current voltage of about −800 volts was thereafter applied to shaft 12 through switch 33b and the photoconductive insulating layer 14 was charged prior to exposure by means of corotron wire 34 of charging station 16 connected to a fixed output high voltage power supply 35. Prior to exposure, the voltage across the electrophotographic insulating layer 14 was measured prior to and after reduction of the voltage applied to shaft 12 down to 0 volts. The charge across insulating layer 14 with the applied direct current voltage of about −800 volts was about +800 volts. However, when the direct current voltage of −800 volts was removed, the voltage across insulating layer 14 was recorded at 1,600 volts. The initial charge and expected subsequent dark decay based on such a high initial charge is illustrated in FIG. 7 as Curve B. The initial charge and subsequent actual dark decay was plotted and is illustrated in FIG. 7 as Curve C. The low dark decay and avoidance of charge injection at such a high initial charge was totally unexpected. These tests were conducted with a photoreceptor comprising an alloy of selenium, arsenic and chlorine. A description of the corona generator employed for charging may be found in U.S. Pat. No. 3,764,866, the disclosure of which is incorporated herein in its entirety.

Figure 8:
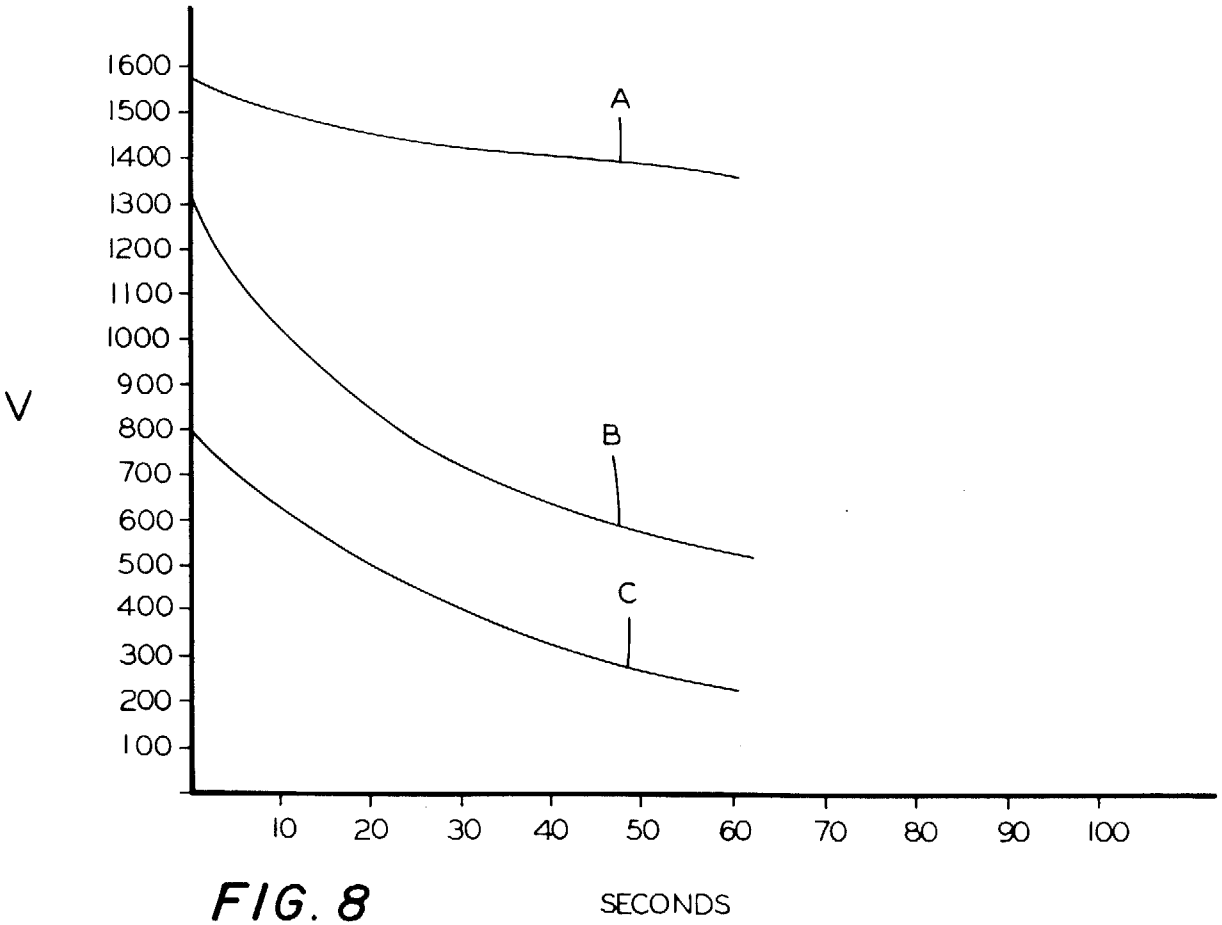
FIG. 8 is a graph comparing an embodiment of this invention with the prior art.

The procedures described above using the photoreceptor comprising an alloy of selenium, arsenic and chlorine was repeated except that a photoreceptor having layer of an alloy of selenium and tellurium overlying the alloy of selenium, arsenic and chlorine was substituted for the photoreceptor comprising an alloy of selenium, arsenic and chlorine. This selenium-tellurium alloy photoreceptor also showed unexpected dark delay such as observed in FIG. 7. Curve A in FIG. 8 shows low dark decay and avoidance of charge injection for a high initial charge. The procedure for generating this high initial charge was the same as used for curve C in FIG. 7. Curve B in FIG. 8 shows less dark decay than curve C, from 800 V to 550 V which is unexpected since both curves were generated with the photoreceptor conductive substrate 11 at −300 volts DC.

It has been found that as much as 2,400 volts may be generated on a 60 micrometers thick selenium photoreceptor with a coronode at +4700 volts DC by applying a negative voltage of −2,000 volts to the photoreceptor substrate. The contrast effect is visible with as little as −100 volts DC applied. With the high voltage power supply at nominal operating set points, as much as −1,200 volts DC could be applied to the photoreceptor substrate before exceeding the voltage breakdown of the developer. The DC supply employed was a KEPCO, Flushing, N.Y., regulated DC supply, Model ABC 1500u, Serial E-17601 having with an output of 0–1500 V, 0∝10 uA. The specification for the high voltage charging supply was set for a constant current regulation, adjustable over the range of 200 uA DC at 4200–5000 volts in 600 uA DC at 4200–5000 volts. The developer housing bias voltage for the above can be either floating (electrically insulated from ground) or appropriately set to maintain a 50–350 volt cleaning field.

If $V_{image}$ and $V_{BG}$ remain fixed in an electrophotographic imaging system, and only the bias voltage of the developer applicator is altered, an increase in the voltage bias tends to reduce the overall development field and wash out both line images and solid areas. Decreasing the bias voltage increases the development field and increases both the line density and solid area density. In order to deliberately wash out low density line images, the bias voltage on the developer applicator must be increased but the image pontential must also be increased in order to retain good solid area density. However, when the image potential is increased, the background voltage increases and undesirable low density images reappear. This is addressed in the prior art such as in U.S. Pat. No. 4,310,237, U.S. Pat. No. 2,956,487 and British Pat. No. 1,559,341 through the use of three separate controls.

A variable direct current voltage may be applied by programable low voltage power supply 33 through potentiometer 38, switch 40 and conductive strip 42 to shaft 24 of applicator cylinder 22 to control brightness of the final toner image. Application of a direct current voltage to a development electrode per se is well known in the art. However, the combination of controlling contrast and brightness with a single low voltage power supply eliminates the need of adjusting a charge corotron high voltage supply and also obviates the necessity to adjust the exposure system by means of complex light fixtures, filters, masks and the like. Referring again to FIG. 5, the bias voltage (Curve E) is increased as the photoreceptor substrate voltage is increased. The bias voltage range (vertical dashed lines) is also shown and is determined by the brightness control settings. Low voltage power supply 33 electrically biases applicator cylinder 22 to a suitable polarity and magnitude, preferably to a level intermediate that of the background voltage level and image voltage level recorded on the imaging surface of electrophotographic insulating layer 14. By way of example, low voltage power supply 33 may electrically bias applicator cylinder 22 to a voltage range from about 300 volts to about 800 volts. Low voltage power supply 33 is also electrically connected to an electrical ground. When a conductive developer material is employed, the effect of development electrode, i.e. applicator cylinder 22, is moved closer to the imaging surface 17 of the electrophotographic insulating layer 14. Thus, as applicator cylinder 22 rotates, it advances the conductive developer material into contact with the imaging surface 17 of electrophotographic insulating layer 14. In prior art development systems, the more conductive the developer material, the closer the effective electrode. Low voltage power 33 maintains the development electrode, i.e. applicator cylinder 22, at a bias through a resistancebridge. The resistance bridge is only one means of accomplishing automatic bias control. Floating bias (electrically insulating the developer housing from ground) is another. For low percent document area coverage the bias voltage will seek an intermediate level between the background voltage ($V_{BG}$) and the image voltage ($V_{image}$). A controlling circuit is preferably employed with floating bias such as a constant current source or Zener Diode arrangement in series with a voltage source. A low cost solid state controller may be substituted for the programmable power supply and may include power supply outputs for both $V_{bias}$ and $V_{substrate}$. Alternatively, separate programmable power supplies may be utilized to supply variable voltage to the conductive substrate and to the electically conductive member.

As applicator cylinder 22 rotates, the conductive developer material is transported closely adjacent to the imaging surface 17 of electrophotographic insulating layer 14. In the development zone between applicator cylinder 22 and the imaging surface 17 of electrophotographic insulating layer 14, the electrostatic latent image attracts the toner particles from the granule particles. Applicator cylinder 22 can also be totally electrically insulated from the surrounding environment by means of switch 40. Thus, applicator cylinder 22 is electrically floating without an electrical bias supplied by low voltage power supply 33. Hence, shaft 24 is effectively electrically disconnected from the electrical ground. As illustrated schematically FIG. 1, switch 40 simulates the insulation between applicator cylinder 22 and the electrical ground when in the open position. In this way, the resistance between applicator cylinder 22 and the electrical ground approaches infinity and applicator cylinder 22 is electrically insulated from its surrounding environment, i.e. electrically floating.

Preferably, the conductive developer material employed in magnetic brush developing station 20 includes carrier granules having a ferromagnetic core which may be overcoated with a non-continuous layer of resinous material to control conductivity. Suitable resins include poly(vinylidene fluoride) and poly(vinylidene-fluorodecotetrafluoroethylene). Alternatively, the ferromagnetic core may be coated with a continuous layer of resinous material provided that the resinous material is loaded with a conductive material. The developer materials may be prepared by mixing the carrier granules with toner particles. Generally, any suitable toner particles known in the art may be mixed with the carrier granules. Typical toner particles are prepared by finely grinding a resinous material and mixing it with a colorant. By way of example, the resinous material may be a vinyl polymer such as polyvinyl chloride, polyvinylidene chloride, polyvinyl acetate, polyvinyl acetal, polyvinyl ether, polyacrylate resin, and the like. Typical coloring materials include chromogen black, solvent black, and the like. The developer material comprises from about 95 percent by weight to about 99 percent by weight of the carrier granules and from about 5 percent by weight to about 1 percent by weight of the toner particles. These and other materials are disclosed, for example, in U.S. Pat. No. 4,076,857 to Kasper et al, the disclosure being incorporated herein in its entirety. Preferably, the conductive magnetic brush developer material has an electrical breakdown voltage ranging from about 14 volts to about 1,000 volts. More insulating developer may also be used (such as Xerox 3100, having a conductivity of less than $10^{-16}$ ohm-cm$^{-1}$ for thicker photoreceptor (e.g. about 60 micrometers) and at suitable development voltages. Developer conductivity can be between about $10^{-10}$ to $10^{-16}$ ohm-cm$^{-1}$ as measured in a Guttman Standard Cell which comprises a stationary cylindrical magnetic brush applicator electrode having a diameter of about 1.5 inches spaced about 0.1 inch from a flat electrode. Conductivity beyond $10^{-10}$ ohm-cm$^{-1}$ increases the likelihood of electrical breakdown at high voltages. If a conductivity of about $10^{-16}$ ohm-cm$^{-1}$ is exceeded, solid area development begins to diminish noticably, particularly at low voltages. Thinner photoreceptors permit greater response for a given substrate voltage range compared to a system using a thicker photoreceptor which allows lower voltages which in turn permit the use of supplier control circuits and eliminates the need for transformers and other equipment necessary for high voltages.

Referring again to FIG. 1, applicator cylinder 22 is electrically insulated from its surrounding environment. For example, shaft 24 is electrically insulated from its surrounding environment so that applicator cylinder 22 is electrically floating, i.e. the switch 40 is in the open position. Thus, applicator cylinder 22 electrically floats relative to ground.

In operation drum 10 rotates so that the discharged strip on the side of the electrophotographic insulating layer 14 adjacent the latent image passes through the development nip between the applicator cylinder 22 and the imaging surface 17 of electrophotographic insulating layer 14. The discharge strip is only one of several control schemes to prevent the bias from floating too high or too low. Other control schemes include Zener Diodes in series with a voltage sourse or ground, or a constant current source, a combination thereof or the like. A control circuit is desired for reasonable operation of the system. This allows a stable contrast development of the photoconductive surface and improves low density contrast. Simultaneously, the electrostatic latent image moves into the development zone. A conductive developer material comprising magnetic carrier particles having toner particles adhering triboelectrically thereto are attracted by brush forming magnet **23*b* to applicator cylinders 22 and advances therewith into the development nip. The brush-like fibers of conductive developer material 26 extending outwardly from applicator cylinder 22 contact the electrostatic latent image in the development nip. The surface of applicator cylinder 22 in the development nip acts as a conductive development electrode. The charge on the imaging surface 17 passing through the development zone, as well as any triboelectric charge of the brush of the developer material on the imaging surface 17 of electrophotographic insulating layer 14, induces a charge on applicator cylinder 22. The magnitude of this induced charge is sufficient to build up a charge on applicator cylinder 22 which electrically biases applicator cylinder 22 to a level intermediate that of the background or non-image areas recorded on the photoconductive surface 12 and that of the image regions, i.e. the electrostatic latent image. Thus, the toner particles will be attracted from the carrier particles only to the image regions, i.e. those areas of potential greater than the potential induced on applicator cylinder 22. In this way, the electrical bias induced on applicator cylinder 22 is floating and is dependent upon the charge on the imaging surface 17 of electrophotographic insulating layer 14 with development occuring substantially independently of the background voltage on the photoconductive surface. This significantly increases the latitude of the system and reduces the effect of cycle-up or residual voltage. An electrically floating applicator cylinder 22** in combination with a conductive developer material optimizes development of low density solid areas and lines since the bias voltage can be set that increment lower than is normally acceptable for photoreceptor cycle-up.

Resistors $R_1$, $R_2$, $R_3$, $R_4$, and $R_5$ shown in FIG. 1 are optional and were employed to set the initial voltage output range of the low voltage power supply 33. One or more of these resistors may be omitted depending on the particular power supply selected and the specific voltage range desired.

In summary, it is clear that the development apparatus of the present invention utilizes a developer roll for transporting conductive developer into a development zone, the developer roller being electrically insulated from its surrounding environment so as to be electrically floating. In this way, the potential on the photoconductive surface induces a charge on the developer roll which forms an electrical bias intermediate the background voltage and image voltage recorded on the photoconductive surface. Thus, the electrical bias on the developer roller floats. The development apparatus of the present invention provides a contrast brightness control, eliminates the need for an exposure control, and provides the capability to charge photoconductors to high internal fields. Contrast brightness control is achieved by simultaneously changing or adjusting V and $V_{bias}$ with two variable controls that do not require operator skill. No control or feedback signals are necessary. Moreover, higher surface potentials can be attained by biasing the substrate than can be obtained by simply increasing the coronode potential for a given charging system. Also, there is less related photoreceptor spot defect failure at high photoreceptor surface potentials.

Thus, solid area development can be increased, low density line reproduction can be significantly increased, background can be suppressed and floating bias may be utilized without altering the photoreceptor, developer, high voltage power supply or light source. Moreover, contrast and brightness may be controlled by manipulation of two simple controls by an untrained operator with alteration of either contrast or brightness not affecting the other. Thus, for example, contrast can be increased without washing out the final image. Also, higher surface potentials can be attained by biasing the substrate than can be obtained by simply incresing the coronode potential for a given charging system. Further, there is less related photoreceptor spot defect failure at high photoreceptor surface potentials.

Other modifications of the present invention will occur to those skilled in the art based upon a reading of the present disclosure. These are intending to be included within the scope of this invention.

I claim:

1. An electrostatographic imaging system comprising an imaging member comprising an electrically conductive substrate and at least one electrostatographic insulating layer having an imaging surface, means to form an electrostatic latent image on said imaging surface, means to form a toner image on said imaging surface in conformance to said electrostatic latent image, and means to supply a variable direct current voltage to said electrically conductive substrate.

2. An electrostatographic imaging system in accordance to claim 1 wherein said means to form a toner image on said imaging surface includes an electrically conductive member parallel to and spaced from said imaging surface.

3. An electrostatographic imaging system in accordance to claim 2 including means to supply a variable electrical bias to said electrically conductive member in response to a change of said direct current voltage supplied to said electrically conductive substrate.

4. An electrostatographic imaging system in accordance to claim 3 wherein said means to supply a variable electrical bias to said electrically conductive member comprises a resistance bridge electrically linking said electrically conductive member with said means to supply a variable direct current voltage to said electrically conductive substrate.

5. An electrostatographic imaging system in accordance to claim 3 wherein said means to supply a variable electrical bias to said electrically conductive member in response to a change of direct current voltage supplied to said electrically conductive substrate includes a potentiometer for controlling said variable electrical bias to said electrically conductive member.

6. An electrostatographic imaging system in accordance to claim 1 wherein said means to supply said variable direct current voltage to said electrically conductive substrate comprises a programmable voltage supply.

7. An electrostatographic imaging system in accordance to claim 1 wherein said means to supply a variable direct current voltage to said electrically conductive substrate includes a potentiometer for controlling said variable direct current voltage to said electrically conductive substrate.

8. An electrostatographic imaging system in accordance to claim 1 wherein said electrostatographic insulating layer is a photoconductive insulating layer.

9. An electrostatographic imaging system in accordance to claim 9 wherein said means to form an electrostatic latent image on said imaging surface comprises means to uniformly charge said photoconductive insulating layer and means to expose said photoconductive insulating layer to activating radiation in image configuration.

10. An electrostatographic imaging system in accordance to claim 1 including a variable contrast control and a variable brightness control.

* * * * *